US009423169B2

(12) United States Patent
Kim

(10) Patent No.: US 9,423,169 B2
(45) Date of Patent: Aug. 23, 2016

(54) DEFROSTING SYSTEM AND METHOD OF REFRIGERATION

(75) Inventor: Seoyoung Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 1256 days.

(21) Appl. No.: 12/909,921

(22) Filed: Oct. 22, 2010

(65) Prior Publication Data

US 2011/0094245 A1 Apr. 28, 2011

(30) Foreign Application Priority Data

Oct. 22, 2009 (KR) ..... 10-2009-0100805

(51) Int. Cl.
*F25D 21/02* (2006.01)

(52) U.S. Cl.
CPC ..... *F25D 21/02* (2013.01)

(58) Field of Classification Search
CPC ..... F25D 21/00; F25D 21/002; F25D 21/02; F25B 47/006; F25B 47/02; F25C 5/187; F25C 2700/02
USPC ..... 62/128, 150, 151, 154, 155; 374/130; 356/43; 250/330
See application file for complete search history.

(56) References Cited

U.S. PATENT DOCUMENTS 8,156,748 B2 * 4/2012 Ashrafzadeh ..... F25C 5/187 62/135
8,713,949 B2 * 5/2014 Chase ..... F25C 5/187 62/125
9,032,745 B2 * 5/2015 Ashrafzadeh ..... F25C 5/187 62/135
2004/0047623 A1 * 3/2004 Top et al. ..... 396/427
2005/0120727 A1 * 6/2005 Flinner et al. ..... 62/126
2008/0105822 A1 * 5/2008 King ..... 250/330
2008/0143338 A1 * 6/2008 Sekine et al. ..... 324/503
2008/0149837 A1 * 6/2008 Bagley et al. ..... 250/341.8
2008/0304741 A1 * 12/2008 Brunner et al. ..... 382/168

FOREIGN PATENT DOCUMENTS

JP 2008232605 A 10/2008

OTHER PUBLICATIONS

Office Action dated May 24, 2016 in Korean Application No. 10-2009-0100805.

* cited by examiner

*Primary Examiner* — Cassey D Bauer
*Assistant Examiner* — Christopher R Zerphey
(74) *Attorney, Agent, or Firm* — Saliwanchik, Lloyd & Eisenschenk

(57) ABSTRACT

Disclosed is a defrosting system and a defrosting method of a refrigerator, the system including an evaporator configured to reduce an ambient temperature by heat exchange through movement of refrigerant, a frost monitoring camera by photographing a state of frost adhered to the evaporator, a controller configured to grasp changes of an image captured by the frost monitoring camera to determine a defrosting start time, and a heat-generating unit configured to emit heat in response to a signal applied from the controller to remove the frost, whereby an unnecessary operation of a heat-generating unit is prevented by appropriately coping with an environment that flexibly changes according to an inner situation of a refrigerator and by accurately determining, by the controller, a start time and a completion time of defrosting operation for removing frost adhered to the refrigerator.

11 Claims, 3 Drawing Sheets

DEFROSTING SYSTEM AND METHOD OF REFRIGERATION

CROSS-REFERENCE TO RELATED APPLICATION

This application claims the benefit under 35 U.S.C. §119 of Korean Application No. 10-2009-0100805, filed Oct. 22, 2009, which is hereby incorporated by reference in its entirety.

BACKGROUND OF THE INVENTION

1. Field of the Invention

The present disclosure relates to a defrosting system of a refrigerator configured to remove frost fixedly formed at the refrigerator, and a defrosting method of a refrigerator.

2. Description of the Related Art

In general, a refrigerator stores food by refrigerating and freezing the food using a cool air supplied and generated by heat exchange with an evaporator. The cool air generated by contact with the evaporator is supplied to a refrigerating chamber and a freezing chamber to perform a heat exchange with the stored food. The cool air that has circulated inner spaces of the refrigerating chamber and the freezing chamber is in turn supplied into a heat exchange chamber installed with the evaporator via a predetermined circulating path. The refrigerating chamber introduces an external air thereinto by way of opening and closing doors, where the introduced external air circulates along the circulating path inside the refrigerator as mentioned above.

At this time, humidity included in the air circulating the interior of the refrigerator adheres to a surface of the evaporator to grow as frost by way of contact with the evaporator.

An increased amount of grown frost causes great hindrance to heat exchange efficiency and ill affects an air path passing through the evaporator, such that, if the frost exceeding a predetermined amount is completely adhered to the surface, a defrosting operation is performed using a separately-provided defrosting heater.

The defrosting heater is generally mounted at a downstream section of an evaporator, which is to heat the evaporator by moving a hot air generated by the defrosting heater upwards by way of convection current.

Meanwhile, a power is supplied to the defrost heater if the defrosting operation is performed, and the frost adhered to the surface of the evaporator near the defrosting heater is melted away by the heat generated by the defrosting heater, and the heat from the defrosting heater is gradually transmitted upwards of the evaporator by the convection current to gradually defrost and remove the frost fixed at the surface of the evaporator.

The operation of the defrosting heater is controlled by time in consideration of opening/closing frequency of refrigerator doors. A high temperature exceeding 300° C. may be generated by an inaccurate operation of defrosting system to decrease a refrigerating/freezing efficiency, or to fail to cope with an inner environmental change that flexibly changes in response to an inner situation of the refrigerator, whereby the frosting operation is not performed at an opportune time to deteriorate the refrigerating/freezing performance.

Therefore, a lengthened opening time of a door on the refrigerator makes the defrosting heater operate frequently to decrease the accuracy and efficiency of defrosting operation.

BRIEF SUMMARY

The present disclosure has been made to substantially obviate one or more problems due to limitations and disadvantages of the related art, and therefore, the present disclosure is directed to a defrosting system configured to prevent an unnecessary operation of a heat-generating unit by appropriately coping with an environment that flexibly changes according to an inner situation of a refrigerator and by accurately determining a start time and a completion time of defrosting operation for removing frost adhered to the refrigerator, and a defrosting method of a refrigerator.

Technical subjects to be solved by the present disclosure are not restricted to the above-mentioned description, and any other technical problems or subject matters not mentioned so far will be clearly appreciated by those skilled in the art to which the present disclosure pertains without difficulty.

In one general aspect of the present disclosure, a defrosting system of a refrigerator is provided, comprising: an evaporator configured to reduce an ambient temperature by heat exchange through movement of refrigerant; a frost monitoring camera by photographing a state of frost adhered to the evaporator; a controller configured to grasp changes of an image captured by the frost monitoring camera to determine a defrosting start time; and a heat-generating unit configured to emit heat in response to a signal applied from the controller to remove the frost.

In some exemplary embodiments of the present disclosure, the controller may compare a photographing start time of the frost monitoring camera with an RGB value of an image captured at a predetermined time interval to determine a defrosting start time.

In some exemplary embodiments of the present disclosure, the defrosting start time may be determined by comparing at least one of the frost photographing start time, a gray scale change value of an image captured at the predetermined time interval, a black color ratio and a white color ratio, with a pre-set threshold value.

In some exemplary embodiments of the present disclosure, the frost monitoring camera may further include an illuminating unit configured to illuminate the frost.

In some exemplary embodiments of the present disclosure, the heat generating unit may be a heater configured to generate a heat, or a steam generator configured to inject a steam in a case a power is applied.

In another general aspect of the present disclosure, a defrosting system of a refrigerator is provided, comprising: an evaporator configured to reduce an ambient temperature by heat exchange through movement of refrigerant; a frost monitoring camera by photographing a state of frost adhered to the evaporator; a controller configured to grasp changes of an image captured by the frost monitoring camera to determine a defrosting start time and a defrosting completion time; and a heat-generating unit configured to emit heat in response to a signal applied from the controller to remove the frost.

In some exemplary embodiments of the present disclosure, the controller may compare a photographing start time of the frost monitoring camera with an RGB value of an image captured at a predetermined time interval to determine a defrosting start time.

In some exemplary embodiments of the present disclosure, the defrosting start time may be determined by comparing at least one of the frost photographing start time, a gray scale change value of an image captured at the predetermined time interval, a black color ratio and a white color ratio, with a pre-set threshold value.

In some exemplary embodiments of the present disclosure, the controller may compare the defrosting start time of the heat generating unit with an RGB value of an image captured at a pre-set time interval to determine a defrosting completion time.

In some exemplary embodiments of the present disclosure, the defrosting completion time may be determined by comparing at least one of the defrosting start time of the heat generating unit, a gray scale change value of an image photographed at the predetermined time interval, a changed value of the black color ratio and a changed value of the white color ratio, with a pre-set threshold value.

In still another general aspect of the present disclosure, a defrosting method of a refrigerator, comprising: photographing a state of frost adhered to an evaporator; grasping whether a gray scale change value of the photographed image is greater than a threshold value to determine a defrosting start time; and emitting a heat to the evaporator to remove the frost if it is determined that the gray scale change value is greater than the threshold value.

In some exemplary embodiments of the present disclosure, the method may further include illuminating the frost when the state of the frost is photographed by a frost monitoring camera, where the state of frost is photographed by the frost monitoring camera.

In some exemplary embodiments of the present disclosure, the gray scale change value may be a change value of gray scale color determined in an RGB value of the photographed image at the photograph start time as time lapses.

In some exemplary embodiments of the present disclosure, the method may further include removing an embedded humidity of the frost monitoring camera or a frost generated inside the frost monitoring camera by turning on the power of the frost monitoring camera, if it is determined that the power of the frost monitoring camera is turned off over a predetermined period of time.

In still further another general aspect of the present disclosure, a defrosting method of a refrigerator, comprising: photographing a state of frost adhered to an evaporator; grasping whether a gray scale change value of the photographed image is greater than a threshold value to determine a defrosting start time; emitting a heat to the evaporator to remove the frost if it is determined that the gray scale change value is greater than the threshold value; determining a defrosting completion time by determining whether the gray change value is less than the threshold value; and stopping the defrosting operation if it is determined that the gray change value is less than the threshold value.

In some exemplary embodiments of the present disclosure, the method may further include illuminating the frost when the state of the frost is photographed by the frost monitoring camera, where the state of frost is photographed by the frost monitoring camera.

In some exemplary embodiments of the present disclosure, the gray scale change value may be a change value of gray scale color determined in an RGB value of the photographed image at the photograph start time as time lapses.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
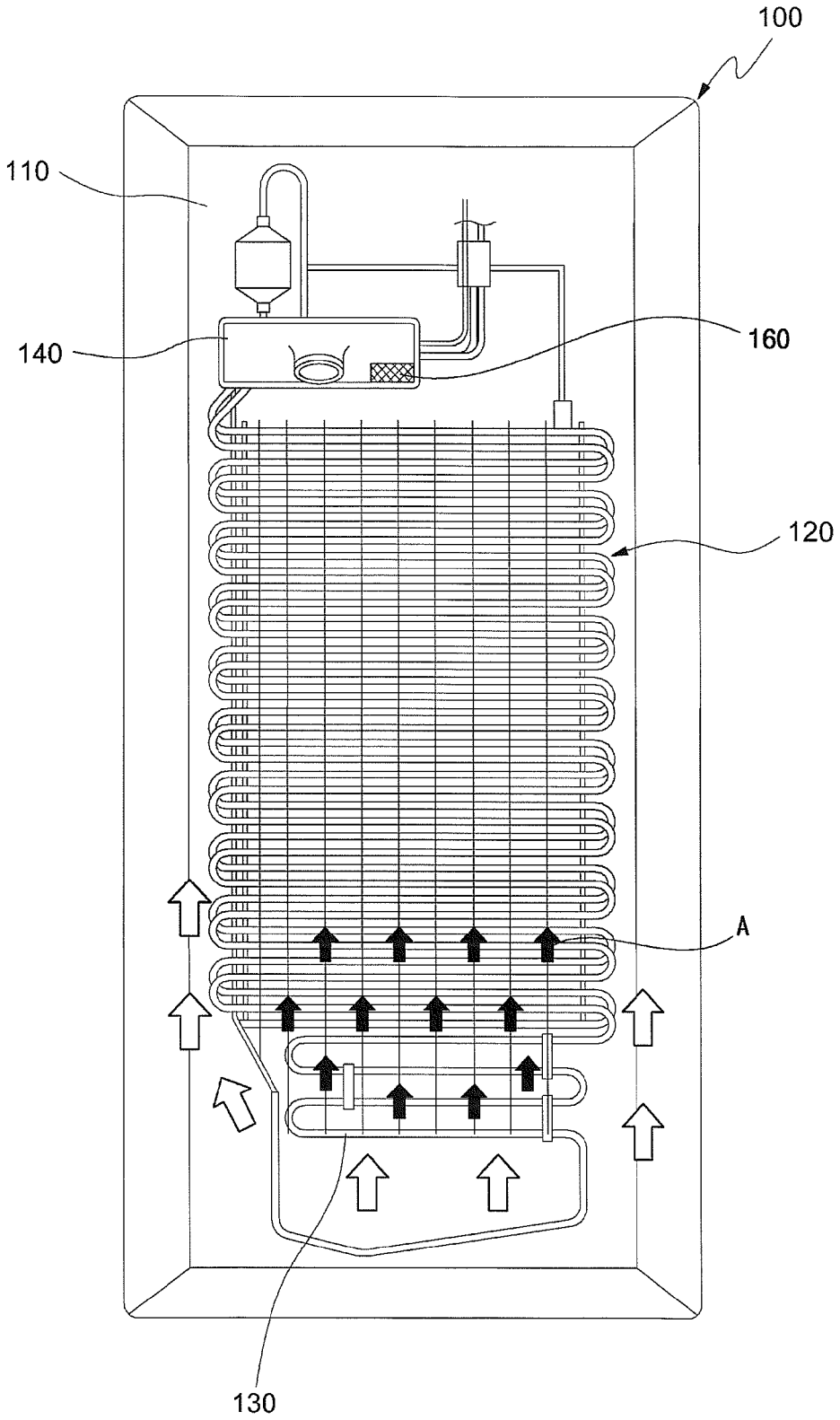
FIG. 1 is a structural view illustrating a defrosting system of a refrigerator according to an exemplary embodiment of the present disclosure.

Hereinafter, exemplary embodiments of the present disclosure are described in detail with reference to the accompanying drawings. In the drawings, sizes or shapes of constituent elements may be exaggerated for clarity and convenience.

Particular terms may be defined to describe the disclosure in the best mode as known by the inventors. Accordingly, the meaning of specific terms or words used in the specification and the claims should not be limited to the literal or commonly employed sense, but should be construed in accordance with the spirit and scope of the disclosure. The definitions of these terms therefore may be determined based on the contents throughout the specification. Acronyms are used extensively throughout the description to avoid excessively long descriptive phrases. The meaning will be clear from the context of the description.

Figure 2:
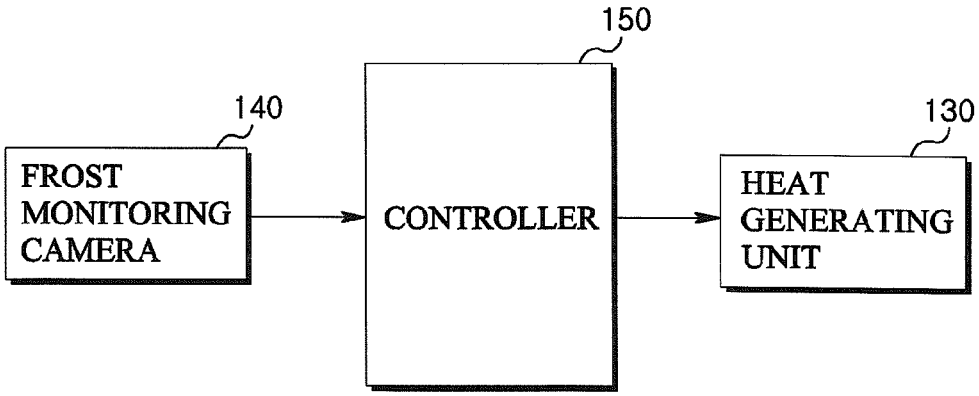
FIG. 2 is a block diagram illustrating a controller in a defrosting system of a refrigerator according to an exemplary embodiment of the present disclosure.

FIG. 1 is a structural view illustrating a defrosting system of a refrigerator according to an exemplary embodiment of the present disclosure, and FIG. 2 is a block diagram illustrating a controller in a defrosting system of a refrigerator according to an exemplary embodiment of the present disclosure.

Referring to FIG. 1, a defrosting system of a refrigerator may include a heat exchange chamber 110, an evaporator 120, a heat generating unit 130, a frost monitoring camera 140 and a controller 150.

The heat exchange chamber 110, connected to the evaporator 120 at a rear side of a main body 100 of the refrigerator, sends an air introduced into the refrigerator to the evaporator 120 for heat exchange, and re-sends the air to the refrigerator. The heat exchange chamber 110 is mounted with the evaporator 120 therein.

The evaporator 120 rapidly reduces the ambient temperature by way of heat exchange through the movement of refrigerant. The heat generating unit 130 is mounted at a lower side of the evaporator 120 to operate for removal of frost adhered to the evaporator 120. The heat generating unit 130 may take the shape of 'U' across the ends in repeated bent style to improve the heat generating efficiency.

The controller 150 compares an image photographed by the frost monitoring camera 140 with a stored image to determine a defrost operation start time, and a signal generated therefrom is applied to the heat generating unit 130 to operate the heat generating unit 130 and remove the frost.

The controller 150 may also determine a defrost operation completion time based on the image photographed by the frost monitoring camera 140.

The heat generated by activation of the heat generating unit 130 is transmitted upwards by convection current as shown in an arrow A. The heat generating unit 130 may be a steam generator which generates a heat or a steam, whereby the steam is injected to the evaporator 120 to remove the frost in a case a power is supplied.

The frost monitoring camera 140 may be mounted at an upper side of the main body 100 to photograph a frost state in the evaporator 120 and to transmit the photographed image to the controller 150. Furthermore, the frost monitoring camera 140 may be mounted at one side thereof with an illumination unit 160 for illuminating the frost when the frost is photographed by the frost monitoring camera 140.

The controller 150 may monitor the changes of image photographed by the frost monitoring camera 140 to determine a defrost start time of the adhered frost. The controller 150 may determine the defrost start time and defrost completion time.

The frost monitoring camera 140 may be mounted at an appropriate position of the main body 100 capable of monitoring the frost state. The controller 150 may grasp the changes of image photographed by the frost monitoring camera 140 to determine an activation start time and completion time of the heat generating unit 130.

The frost monitoring camera 140 conducts a photographing operation only at a pre-set time unlike the ON-state of refrigerator power. An operation period of the frost monitoring camera 140 may be set up by a user.

Figure 3:
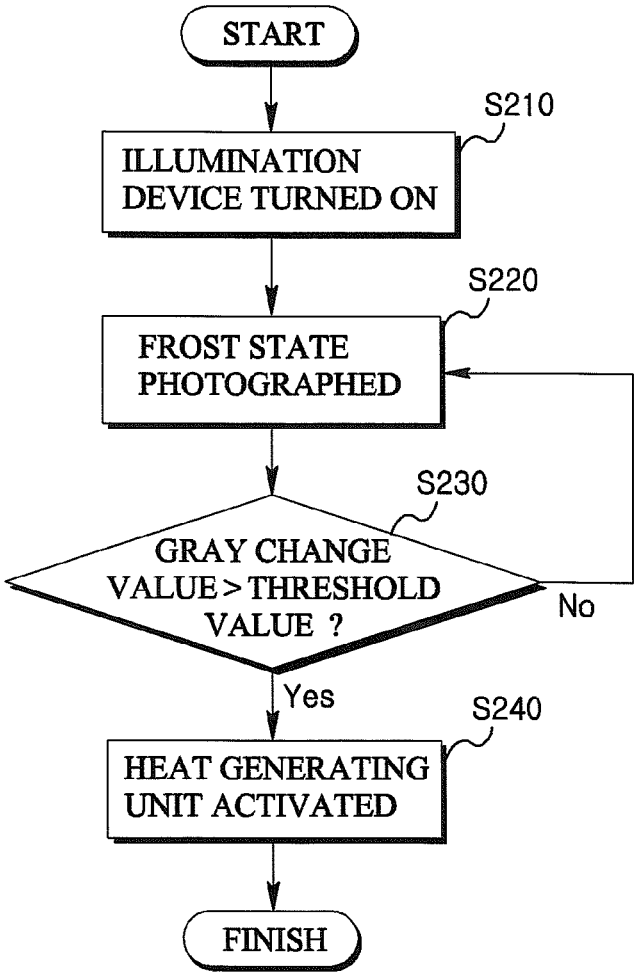
FIG. 3 is a flowchart illustrating a defrosting method of a refrigerator according to an exemplary embodiment of the present disclosure.

FIG. 3 is a flowchart illustrating a defrosting method of a refrigerator according to an exemplary embodiment of the present disclosure.

Referring to FIG. 3, a defrosting method of a refrigerator may include, first of all, activating an illumination unit 160 for photographing of the frost monitoring camera 140 ($S_{210}$). Because an illumination power is operated only when an interior of the refrigerator is opened, it is necessary to install a separate illumination for photographing of the frost monitoring camera 140. For example, the illumination unit 160 may be a low-power consuming LED (Light Emitting Diode).

The illumination unit 160 may be controlled to be simultaneously turned off with the power-off of the frost monitoring camera 140.

Successively, the frost monitoring camera 140 disposed at the main body 100 may be used to photograph the frost state of the evaporator 120 ($S_{220}$). The frost monitoring camera 140 may photograph a still image at a predetermined time interval. Furthermore, the frost monitoring camera 140 may also photograph a moving image at a predetermined time interval. In case of photographing the moving image, an image comparison among frames (to be explained later) may be implemented.

In a case the frost monitoring camera 140 is turned off for a long time, a power is supplied to the frost monitoring camera 140 to thereby be given with a self heat generating time, whereby an embedded humidity or frost generated inside the camera may be removed.

Thereafter, a determination is made as to whether a gray scale change value of the image photographed at the photograph start time and at a pre-set time interval is greater than a threshold value ($S_{230}$).

At this time, the "gray scale change value" is defined by a change value of gray color determined in RGB value of image. Although a black color is dominant color at the photograph start time due to no frost adhered to a gap of the evaporator 120, the frost is adhered to the gap of the evaporator 120 in a predetermined time to allow the ratio of the gray color to be increased.

The threshold value used for the defrost operation start time and completion time (described later) may be determined by using statistical numerals. If it is determined that the gray scale change value of photographed image is greater than the threshold value, the heat generating unit 130 is activated ($S_{240}$).

In a case the heat generating unit 130 is activated to remove the frost, the heat generated by the activation of the heat generating unit 130 is transmitted upwards by convention current to remove the frost adhered to the evaporator 120.

The heat generating unit 130 may be a steam generator for removing the frost by injecting steam to the evaporator 120 using heat or steam. The heat generating unit 130 discontinues operating after operation for a predetermined period of time, and repeats the control operation thus explained.

At this time, the time in which the heat generating unit 130 is driven is a time sufficient enough to defrost, and a time that does not affect the refrigeration and freezing performances in response to the driving of the heat generating unit 130.

Figure 4:
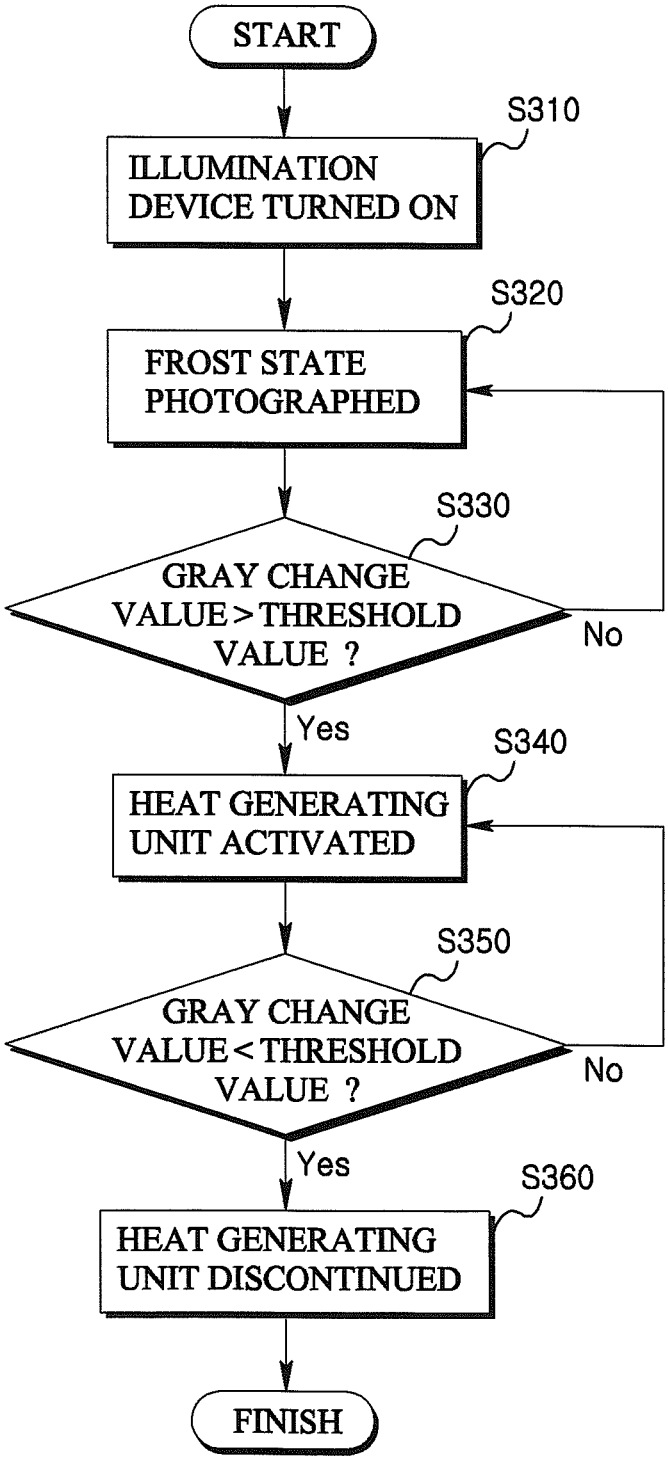
FIG. 4 is a flowchart illustrating a defrosting method of a refrigerator according to another exemplary embodiment of the present disclosure

In some exemplary embodiments of the present disclosure, the method may further include illuminating the frost when the state of the frost is photographed by the frost FIG. 4 is a flowchart illustrating a defrosting method of a refrigerator according to another exemplary embodiment of the present disclosure.

The defrosting method of a refrigerator according to another exemplary embodiment of the present disclosure includes activating the illumination unit 160 for photographing of the frost monitoring camera 140 ($S_{310}$).

Successively, the frost monitoring camera 140 mounted at the main body 100 of the refrigerator is used to photograph the frost state of the evaporator 120 ($S_{320}$). The frost monitoring camera 140 may photograph a still image at a predetermined time interval. Furthermore, the frost monitoring camera 140 may also photograph a moving image at a predetermined time interval. In case of photographing the moving image, an image comparison among frames (to be explained later) may be implemented.

In a case the frost monitoring camera 140 is turned off for a long time, a power is supplied to the frost monitoring camera 140 to thereby be given with a self heat generating time, whereby an embedded humidity or frost generated inside the camera may be removed.

Thereafter, a determination is made as to whether a gray scale change value of the image photographed at the photograph start time and at a pre-set time interval is greater than a threshold value ($S_{330}$).

At this time, the "gray scale change value" is defined by a change value of gray color determined in RGB value of image. Although a black color is dominant color at the photograph start time due to no frost adhered to a gap of the evaporator 120, the frost is adhered to the gap of the evaporator 120 in a predetermined time to allow the ratio of the gray color to be increased.

The threshold value used for the defrost operation start time and completion time (described later) may be determined by using statistical numerals. If it is determined that the gray scale change value of photographed image is greater than the threshold value, the heat generating unit 130 is activated ($S_{340}$).

In a case the heat generating unit 130 is activated to remove the frost, the heat generated by the activation of the heat generating unit 130 is transmitted upwards by convention current to remove the frost adhered to the evaporator 120.

Furthermore, a determination is made as to whether a ratio (gray change value) occupied by black color of the image photographed at the frost photograph start time and pre-set time interval is less than the threshold value ($S_{350}$). Although a black color is dominant color at the photograph start time due to no frost adhered to a gap of the evaporator 120, the frost is adhered to the gap of the evaporator 120 in a predetermined time to allow the ratio of the black color to be decreased. In a still further exemplary embodiment of the present disclosure, a frost removal time may be determined using a white color change value of an image photographed at the photograph start time and the pre-set time interval. At this time, the color that is a base for determining the frost removal time may be determined by YUV (YCbCr) value converted by using the RGB value.

It should be apparent to the skilled in the art that, in the still further exemplary embodiment, an operation start time and completion time (described later) for removing the frost can be determined by various methods from the image photographed in response to time change.

In a case the gray scale change value is determined to be less than the threshold value, the heat generating unit 130 is discontinued ($S_{360}$).

As explained in the still further exemplary embodiment, the operation start time and completion time of the heat generating unit 130 (described later) can be also controlled by the image photographed by the frost monitoring camera 140 to enhance the defrosting performance.

That is, the frost monitoring camera 140 is utilized to accurately determine the defrosting start time and completion time for removing the frost, whereby the generated frost can be effectively removed.

Although the present disclosure has been described in terms of exemplary embodiments, the embodiments disclosed in this application are to be considered in all respects as illustrative and not limiting. It should be appreciated that many variations may be made in the embodiments by persons skilled in the art without departing from the scope of the present disclosure as defined by the following claims.

What is claimed is:

1. A method of defrosting for a refrigerator including an evaporator, the method comprising the steps of:

activating an illumination unit for photographing by a frost monitoring camera;

emitting light to a portion of the evaporator;

photographing an image of the portion of the evaporator at a time interval with the frost monitoring camera; and determining whether a gray scale change value of the image photographed is greater than a predetermined threshold value through a controller, wherein the gray scale change value is a change value of gray scale color determined in an RGB value of the photographed image at a photograph start time as time lapses;

wherein the controller is configured to:

compare colors obtained from the photographed image of the portion of the evaporator with colors obtained from a reference image of the portion of the evaporator, wherein the reference image is an image when the camera is initiated;

determine a defrosting start time and a defrosting completion time based on the comparison of the colors, wherein a gray color, a black color, or a white color in the photographed image of the portion of the evaporator is compared with the reference image; and operate a heat-generating unit for a defrosting operation in response to determination by the controller.

2. The method of claim 1, wherein the controller is configured to determine the defrosting start time when:

the gray color in the image of the portion of the evaporator is greater than that of the reference image;

the black color in the image of the portion of the evaporator is less than that of the reference image; or the white color in the image of the portion of the evaporator is greater than that of the reference image.

3. The method of claim 2, wherein the controller is configured to determine the defrosting completion time when:

the gray color in the image of the portion of the evaporator is less than that of the reference image;

the black color in the image of the portion of the evaporator is greater than that of the reference image; or the white color in the image of the portion of the evaporator is less than that of the reference image.

4. The method of claim 1, wherein the heat-generating unit is a heater configured to generate heat, or a steam generator configured to inject steam.

5. The method of claim 4, wherein the illumination unit is activated only for photographing by the camera and is turned off with a power-off of the camera.

6. The method of claim 5, further comprising removing an embedded humidity of the frost monitoring camera or a frost generated inside the frost monitoring camera by turning on the power of the frost monitoring camera, when the power of the frost monitoring camera is turned off over a predetermined period of time.

7. The method of claim 1, wherein the controller is configured to determine the defrosting completion time when:

the gray color in the image of the portion of the evaporator is less than that of the reference image;

the black color in the image of the portion of the evaporator is greater than that of the reference image; or the white color in the image of the portion of the evaporator is less than that of the reference image.

8. The method of claim 1, wherein the image of the portion of the evaporator includes a still image and is obtained periodically at predetermined time intervals.

9. The method of claim 1, wherein the image of the portion of the evaporator includes a moving image and is obtained periodically at predetermined time intervals.

10. The method of claim 1, wherein the controller compares a photographing start time of the frost monitoring camera with an RGB value of an image captured at a predetermined time interval to determine the defrosting start time.

11. The method of claim 1, wherein the controller compares the defrosting start time of the heat generating unit with an RGB value of an image captured at a pre-set time interval to determine the defrosting completion time.

* * * * *